US005273781A

United States Patent [19]

Shu

[11] Patent Number: 5,273,781

[45] Date of Patent: Dec. 28, 1993

[54] METHOD OF MAKING BLIND FABRIC

[76] Inventor: Wang M. Shu, Chuan-Yuan Road, Taipei, Taiwan, 112

[21] Appl. No.: 745,187

[22] Filed: Aug. 15, 1991

[51] Int. Cl.[5] ..... B05D 3/12; B05D 3/02; D21J 3/00

[52] U.S. Cl. ..... 427/176; 427/355; 427/358; 427/366; 427/394; 264/324; 160/236

[58] Field of Search ..... 264/324; 160/236, 900; 427/501, 513, 176, 355, 358, 359, 365, 366, 394

[56] References Cited

U.S. PATENT DOCUMENTS

| | | | |
|---|---|---|---|
| 1,920,541 | 8/1933 | Zavertnik et al. | 427/359 |
| 1,939,842 | 12/1933 | Crumb et al. | 427/359 |
| 2,187,121 | 1/1940 | Graves | 160/236 |
| 3,653,948 | 4/1972 | Krempgen et al. | 427/359 |
| 3,979,478 | 9/1976 | Gallacher . | |
| 4,309,472 | 1/1982 | Götting et al. | 160/236 X |
| 4,324,832 | 4/1982 | Moroff et al. . | |
| 4,758,465 | 7/1988 | McKinney et al. . | |
| 4,940,047 | 7/1990 | Richter et al. . | |
| 4,983,433 | 1/1991 | Shirasaki . | |
| 4,985,278 | 1/1991 | George . | |
| 5,118,532 | 6/1992 | Batson et al. | 427/393.5 |

FOREIGN PATENT DOCUMENTS 816506 7/1959 United Kingdom .

*Primary Examiner*—Marianne Padgett
*Attorney, Agent, or Firm*—Bacon & Thomas

[57] ABSTRACT

A method of making blind fabric utilizing natural or synthetic fibers or fabric as base materials to form an inexpensive fabric used in conjunction with conventional venetian and vertical blinds. The method comprises dipping, compressing, tentering, slitting into desired widths, heating, forming and slitting into desired lengths. Whereas the base material is dipped in a mixed solution of (1) thermoplastic resins, (2) thermosetting resins and (3) polyvinyl formal resin, thereafter, compressing said fabric through roller or the like, then tentering it by a tentering machine, slitting it into different widths, heating it at desired temperature to make the fabric soft in order to obtain a non-brittle, relatively flexible fabric. Finally the fabric will be formed into a curved shape and slit into desired lengths to fit the window size. In addition, the fabric can be treated with ultraviolet stabilizer, fire retardant and dust repellent to achieve desired properties.

20 Claims, 1 Drawing Sheet

METHOD OF MAKING BLIND FABRIC

BACKGROUND OF THE INVENTION

This invention relates to blinds and more particularly to the manufacture of a kind of a flexible resilient synthetic resin with fibers or fabric.

While it has heretofore been proposed to make such blinds of plastic or aluminum, these have been subject to a number of disadvantages, those of which are excessive thickness and weight insufficiency or absence of resiliency and distortion including sagging and twisting.

There are also a number of disadvantages to conventional plastic (PVC) fabric in connection with prior art, those including lack of visual attractiveness, being brittle due to environmental effect, changing color due to age; there are a number of disadvantages in relation to aluminum fabric, those of which are relatively high cost, and, not being aesthetically pleasing. If fabric is used to make vertical blinds, a small part of its bottom should be turned up and a main weight should be inserted in its turned up pocket space in order to increase the verticality of the said fabric and prevent it from oscillation due to wind blowing. In addition, at the bottom of the said fabric vertical blind, ball-chains are connected each other for the convenience of operating the blinds.

An exemplary method such as this is illustrated in U.S. Pat. No. 4,324,832 covering a method of impregnating web structures with a synthetic resin. The said patent uses a solution of a mixture of different acrylic acid esters and aminoplast resins to impregnate a fibrous web structure. Although the fabric treated by this kind of solution possesses flexibility and strength, the fabric processed by conventional method may not be used in vertical blinds and venetian blinds due to the following two disadvantages: (1) If it is flexible, then it will be insufficiently strong, thus the blind will be easily bent and distorted; (2) If it possesses hardness only, it will become brittle easily, which will be more apparent at low temperature in particular.

U.S. Pat. No. 4,500,606 uses phenol formaldehyde resin, epoxy resin and polyvinyl formaldehyde resin to improve the adhesion between plastic leathers, and these resins are just only adhesive agents for plastic internals. However, the present invention is for the sake of textile surface treatment. Therefore, there is a big functional difference in comparison with the said U.S. patent. Moreover, the phenol formaldehyde resin and epoxy resin used in the said U.S. patent easily become brittle and yellowish in the air and are obviously different from the melamine resin and acrylic resin used in the present invention which are brittle-resistant and yellowish resistant. The phenol formaldehyde resin and epoxy resin used in the said U.S. patent are thermosetting resins only, but the present invention uses both the thermosetting resin (e.g. melamine resin) and thermoplastic resin (e.g. acrylic resin). Obviously there is a big difference in the utilization object. Although the said U.S. patent uses also polyvinyl formaldehyde resin, from its description one can clearly see that it uses high polymeric polyvinyl formaldehyde resin which should be dissolved in advance by solvent, but the present invention uses reasonably priced and highly safe aqueous polyvinyl formaldehyde resin (please refer to the Patent Bulletin No. 131894 of the Republic of China).

Therefore, there is a remarkable difference between polyvinyl formaldehyde resin used.

Regarding "Comprehensive Polymer Science", the material described in page 51 to page 77 is polyvinyl acetate and does not use polyvinyl acetal. Obviously there is difference between the present invention and what is well-known.

Therefore, the main object of the present invention is to provide a blind fabric wherein the foregoing disadvantages are reduced to a minimum.

SUMMARY OF THE INVENTION

The present invention discloses a method of making blind fabric, which utilizes fabric made of natural or synthetic fiber, such as cotton, polyester/cotton, polyester/rayon, acrylic fiber, polyester fiber, nylon fiber, acrylic/wool blend and non-woven fabric etc. , as base material to be dipped into a solution of a mixture of polyvinyl formal and two or more resins, so that said base material will absorb said mixed solution in a period of time; thereafter, said base material will be treated by a tentering machine at 150°-200° C. for 30 sec. to 2 min. to obtain a non-brittle, non-yellowish flexible fabric.

The polyvinyl formaldehyde (P.V.F.) is not only excellent in chemical resistance and wear-resistance, but also possesses the well-known physical characteristics: it will not be softened under high temperature and will not become brittle under low temperature. Using a certain percentage of polyvinyl formaldehyde in mixture with other kinds of resins to dip and coat fabrics to achieve better performance in keeping the fabric hard and not brittle under both high and low temperature conditions, as well as to make the fabric flexible and not soft, will be the initial idea.

The fabric material so produced can be extensively used either for venetian blinds, if it is slitted, heated and compressed into curved slats of 1.6 cm, 2.7 cm and 5.4 cm width, or used for vertical blinds if it is made in the same way but in curved slats of 8.95 cm, 10.2 cm and 12.7 cm, whereby due to their high tenacity no main weight and/or bottom ball chain attachment on the bottom of the blind slats are required.

It is observed that fabric so made according to the present invention is suitable for venetian blinds in a way that it is flexible, to resist distortion including sagging and twisting; it is also suitable for vertical blinds due to its sufficient tenacity, such that no additional weight (e.g. bottom ball chain and/or main weight) will be required to facilitate the operation of tilting and adjusting thereof.

It is further observed that the fabric also can be made with comparatively low cost, since the process is simplified and materials required are readily available.

Alternatively, the method according to the present invention shows great versatility in design of blinds to achieve great possibilities of visual attractiveness.

The above described and other objects, features and advantages of the present invention will be more apparent from the following description quoted on the basis of annexed drawings as follows. The preferred embodiment drawing is to explain the present invention and is understood not to limit the present invention.

DETAILED DESCRIPTION OF THE PREFERRED EMBODIMENT

Figure 1:
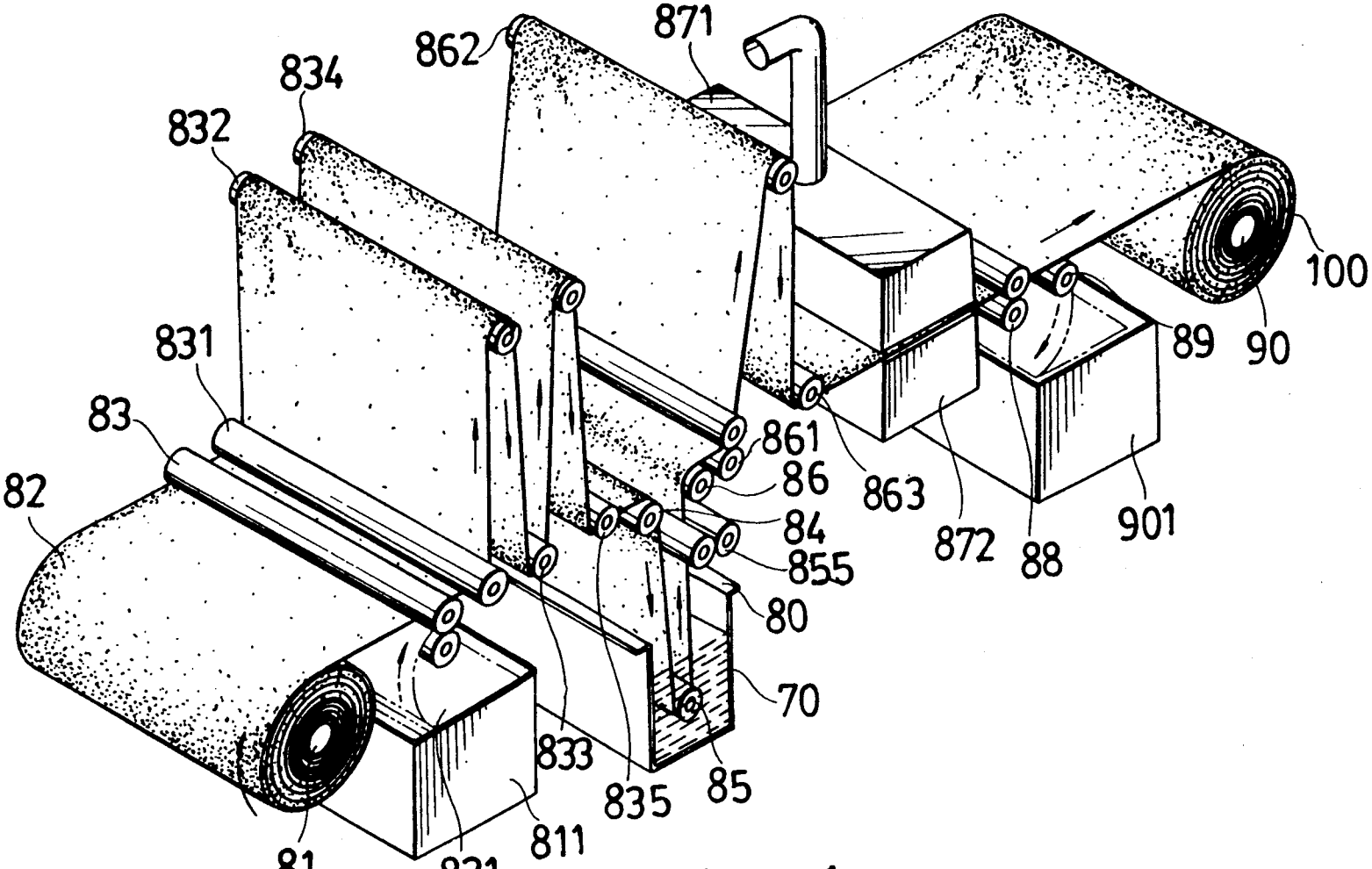
FIG. 1 depicts a flow chart which illustrates the process according to the present invention.

Referring to FIG. 1, the present invention first of all adds two or more kinds of thermoplastic resins to a mixture tank (80) and adds polyvinyl formal with 10%-60% concentration and 30% purity. Then, base material (fabric) (82) can be fed either from a fabric rolling-up device (81) or from a fabric drum (81 1), guided by a pair of front clamp rollers (83), and passed through five rollers (831) (832) (833) (834) (835) one after another by continuous tension action so as to adjust the tension of the said fabric and firmly tension the fabric (82). The said fabric will be continuously transported and directed to a front steering roller (84), and turned 90° downwards into a mixed resin solution tank (80) up to a steering roller (85), so that the fabric can be dipped fully in the said mixed resin solution. The tank (80) is for storage of the prepared mixed resin solution and can keep the resin at a proper concentration and temperature. The fabric (82) treated with the said mixed solution will be clamped by a pair of clamp rollers (85) so that the excess mixed solution can be dropped back into the solution tank (80). By means of controlling the clamping degree of the said clamp rollers (855), the quantity of solution picked-up by the said fabric may be regulated. Several pairs of clamp rollers may be used for such purpose. The fabric (82) will be guided further through a pair of post steering rollers (86) and a plurality of rollers (861) (862) (863) to tension it again, and then fed into a heating installation (87) to dry the fabric (82) by the provided steam setting machine (872). The excess heat will be exhausted by a blower (871) which is provided on the top of the said heating installation. The fabric (82) heat treated under temperature control to a best suitable condition will be further guided by a pair of post clamp rollers (88) and a steering roller (89) and rolled up either by means of a pick-up roller (90) or will be piled in a lower fabric drum (901) as finished blind rolls pending for further compressing, tentering (by a tentering machine), slitting (into desired widths), heating (to soften fabric), forming (to form the fabric into a curved shape) and slitting (into desired lengths to fit the window size) etc.

The present invention utilizes the fabric as base material and applies the mixed solution of two or more kinds of resin together with polyvinyl formal resin to adhere to the fabric material. The fabric is then heat treated by a tentering machine to obtain the blind fabric of the invention.

The resins used for such purpose should be (1) thermoplastic resin, such as acrylic resin, polyurethane resin and polyester resin; (2) thermosetting resin, such as, melamine formaldehyde resin, urea formaldehyde resin, thiourea resin and (3) polyvinyl formal resin. The acrylic resin is normally emulsified and polymerized by acrylic acid ester and a small quantity of acrylic acid and/or methacrylic acid, which is known for its toughness and resistance against aging, weather and abrasion and can be softened during heat treatment at 150° C.-200° C. to help the fabric being set. Polyurethane resin is known for its elasticity, corrosion resistance and thermoplastic softening property. The melamine formaldehyde resin after fabric setting will not be softened by further heat treatment and is helpful to prevent distortion due to heat influence during sea freight container transportation at high temperatures (70°-100° C.) and can improve additionally its water-proof and solvent resistant properties. Polyester resin has excellent properties of color stabilization and resistance of softening and acid.

The use of polyvinyl formal resin (50% degree of acetylation) to treat the fabric has following advantages:

(1) high absorption capacity to increase the adhesion quantity of the resin and increase the fabric tenacity;
(2) the fabric will be flexible at normal ambient temperature;
(3) the fabric will not be brittle in cold temperature;
(4) increased heat-resistance; and
(5) increased chemical resistance.

(50% degree of acetylation means that, in the polyvinyl alcohol, 50% of OH had been acetylated; in other words, if there are 1000 units of polyvinyl alcohol, then there are 500 units which have been acetylated)

In the production of blinds, polyvinyl alcohol is used having degree of polymerization at the average of 500 to 3000 (which indicates that polyvinyl alcohol is polymerized by 500-3000 monomers; the higher polymerizing power of the polyvinyl alcohol, the harder and more wear-resistant will it be), being warmed up in water bath up to 95° C. to mix up a solution of 10% content, then put into a stirrer. 35% hydrochloric acid and formalin are added at a stirring speed of 500 rpm., continuing to stir and keep the mixture solution at 50° C. for 30 minutes. The obtained crystals are then filtered and rinsed with fresh water to obtain polyvinyl formaldehyde powder. Such powder can be used as a 30% pure solution after adding water. The fabrics used in the process are optional, such as cotton, polyester/cotton, polyester/rayon, acrylic fiber, polyester fiber, nylon fiber, acrylic/wool blend and non-woven etc., blended fabrics.

It is also noted that said fabric absorption amount is in the range of 100% to 500% by weight, and preferably 150% to 300%.

In addition to the above discussion, it is possible to include other materials to enhance protection of said fabric. There are a number of additives available, for instance:

Ultraviolet Stabilizer

For example, trade name SAP (made by IWASHIRO CHEMICAL CO), TBS (made by DOW CHEM), DOPS (made by EASTMAN CHEM.), Tinuvin-320 (made by CIBA-GEIGY) etc., serving to improve color fastness against environmental effects;

Fire Retardant

For example, trade name FR-100F (made by CHINA C-BOND CHEM.), serving to increase safety against fire hazard;

Dust Repellent

For example, FC-214 (made by MINNESOTA MINING MANUFACTURING CO.), serving to prevent dust and contamination accumulated thereon.

The fabric so treated can be heated at temperature range 150° C.-200° C. and compressed into curve slats of 1.6 cm, 2.7 cm and 5.4 cm width to be used for mini blind or being heated and compressed to 8.9 cm, 10.2 cm and 12.7 cm curve slats for vertical blinds, whereby due to their high tenacity no main weight and/or bottom ball chain attachment on the bottom of the slats are required, thus the production cost can be considerably reduced.

Since the fabrics are suitable to include alternative chemicals, an ultraviolet stabilizer, fire retardant, and dust repellent can be added thereon for better protective properties, but without affecting the main characteristics of the fabrics, as aforesaid.

Following is an example of treatment steps:

a. Selecting two base materials, acrylic resin 50% and melamine formaldehyde resin 32%, catalyst (a mixed solution of organic amines and inorganic amines, an agent for mixing two kinds of resins) 8%, and polyvinyl formal resin 10%, to form a solution;
b. Dipping fabric (e.g. polyester) into solution prepared as in Step a and having pick-up (absorption) amount of about 150%;
c. Compressing said fabric by rollers maintained a reasonable gap suitable to thickness of said fabric;
d. Tentering the said fabric at 180° C. and slitting the said fabric at desired width size (5.4 cm);
e. Heating the fabric to make the fabric soft;
f. Forming the fabric into a curved slat;
g. Slitting the fabric in desired length (59 cm) to fit the window size.

After such treatment, the fabric shows excellent properties including:

1. being thermoplastic at high temperature of 180° C.;
2. maintaining acceptable shape at 80° C. for 48 hours;
3. exerting good flexibility at being bent 80 times during 144 hours; and
4. being not brittle at −10° C. for 48 hours.

A detailed description of the present invention is illustrated by the following four examples of the preferred embodiments.

1. Formula

| Chemicals | Content | Comparison Example 1 | Comparison Example 2 | Examples of Preferred Embodiments: No. 1 | No. 2 | No. 3 | No. 4 |
|---|---|---|---|---|---|---|---|
| Acrylic resin | 40% | 100% | 0% | 50% | 50% | 50% | 50% |
| m-3 | 30% | 0% | 80% | 40% | 36% | 32% | 24% |
| Medium | 10% | 0% | 20% | 10% | 9% | 8% | 0% |
| Polyvinyl formal resin | 30% | 0% | 0% | 0% | 5% | 10% | 20% |

M-3: a kind of polyvinyl formaldehyde
Medium: A mixed solution of organic amines and inorganic amines.

2. Fabric material: polyester fiber.
3. Absorption quantity: 150%
4. Fabric treatment: Heated and pressed into curved slats in 2.5 cm × 59 cm under 180° C.
5. Results:

| Tested items | CE. No. 1 | CE. No. 2 | EPE. No. 1 | EPE. No. 2 | EPE. No. 3 | EPE. No. 4 |
|---|---|---|---|---|---|---|
| High temperature forming (1) | O | x | O | O | O | O |
| Medium temperature storage (2) | x | O | O | O | O | O |
| Flexibility of ambient temperature (3) | x | + | − | − | + | O |
| Low temperature storage (4) | x | x | x | − | − | O |

Remarks:
CE = Comparison Example
EPE = Example of Preferred Embodiment
O = excellent
+ good
− normal
x = poor
(1) = Whether it can be thermoplasticized at 180° C.
(2) = Whether it can maintain acceptable shape at 80° C. for 48 hours.
(3) = Whether it can exert good flexibility after being bent 80 times by hand during 144 hours
(4) = Whether it will become brittle at −10° C. for 48 hours.

Out of the above mentioned test results, one can clearly see that the results of all of the four examples of preferred embodiments had better performances in comparison with the other two comparison examples. Therefore, the manufacturing method of the present invention is really better than any conventional one, and produces hard, non-brittle, difficult to deform and flexible fabrics.

In connection with those of prior art, the present invention provides the possibility to utilize either natural or synthetic ones, providing better visual effects and a nonexpensive product.

Typically, for venetian blinds (mini blinds), said fabric is suitable inasmuch as it is more flexible than conventional PVC fabric, cheaper than aluminum fabric, and more attractive than either one. For vertical blinds, it is particularly suitable due to its high tenacity property, thus no 15 additional weight and/or chain will be required to maintain its stability.

If a specific property is required, additional chemicals can be utilized. For instance, ultraviolet stabilizer, such as DOPS (trade name, manufactured by EASTMAN CHEMICAL), can be added into solution prepared in step a to improve color fastness property; fire retardant, such as FR-100F (trade name, CHINA C-BOND CHEMICAL) to increase fire hazard safety; and/or dust repellent, as FC-214 (trade name, manufactured by MINNESOTA MINER MANUFACTURE CO.), to prevent from accumulation of dust and contamination.

I claim:

1. A method of making material for use in vertical blinds or venetian blinds comprising:
dipping a fabric into a mixture of resins;
compressing the fabric;
slitting the fabric into widths; and
forming the fabric into curved slats;
wherein the mixture of resins comprises one or more thermoplastic resins, one or more thermosetting resins and polyvinyl formal resin.

2. A method according to claim 1, wherein the mixture of resins comprises acrylic resin, melamine formaldehyde resin and polyvinyl formal resin.

3. A method according to claim 2, wherein the polyvinyl formal resin is present in the concentration amount of 10% to 60% of the mixture of resins.

4. The method of claim 3, wherein the mixture of resins further comprises a polymerization catalyst.

5. A method according to claim 1, wherein the fabric is selected from the group consisting of non-woven fabrics and woven fabrics.

6. A method according to claim 1 wherein the curved slats are slit into desired lengths.

7. A method according to claim 1 wherein the thermoplastic resins are selected from the group consisting of acrylic resins, polyurethane resins and polyester resins.

8. A method according to claim 1 wherein the thermosetting resins are selected from the group consisting of melamine formaldehyde resins, urea formaldehyde resins and thiourea resins.

9. A method according to claim 1, wherein the polyvinyl formal resins are more than 50% acetylated and have a degree of polymerization in the range of 500 to 3000 monomer units in a chain.

10. A method according to claim 1, wherein the fabric is selected from the group consisting of cotton, polyester/rayon, polyester cotton, polyester, acrylic, nylon and acrylic/wool.

11. A method according to claim 1, wherein the fabric has a pick-up to said solution of 100 to 500% by weight.

12. A method according to claim 11, wherein the fabric has a pick-up to said solution of 150 to 300% of weight.

13. A method according to claim 6, wherein the fabric is slit into widths of from 1.6 to 2.3 cm for venetian blinds, and from 5 to 15 cm for vertical blinds.

14. A method according to claim 1, further comprising the addition of an ultraviolet stabilizer into the mixture to improve color-fastness of said fabric.

15. A method according to claim 14, further comprising the addition of fire retardant into the mixture.

16. A method according to claim 15, further comprising the addition of dust repellent into the mixture.

17. A method for making material for use in vertical blinds or venetian blinds comprising:

dipping a polyester fabric into a mixture of resins;

compressing the polyester fabric;

tentering the polyester fabric at 180°;

slitting the polyester fabric into widths of 59 cm ; and forming the polyester fabric into curved slats;

wherein the mixture of reins comprises acrylic resin, melamine formaldehyde resin and polyvinyl formal resin, and the polyester fabric has a pickup (absorption) amount of about 150% by weight.

18. A method according to claim 17, wherein the acrylic resin is present in the amount of 50%, the melamine formaldehyde is present in the amount of 32%, the polyvinyl formal is present in the amount of 10%, and further comprising a catalyst.

19. A method according to claim 18, wherein said catalyst comprises a mixed solution of organic amines and inorganic amines.

20. A method according to claim 19, wherein said catalyst is present in the amount of 8%.

* * * * *